US005622812A

United States Patent [19]

Tatezono et al.

[11] Patent Number: 5,622,812

[45] **Date of Patent: *Apr. 22, 1997**

[54] OPTICAL MATERIAL

[75] Inventors: Fumio Tatezono, Hirakata; Toshio Harada, Ohta; Masahiro Irie, 1-29-4-404, Kasugakouen, Kasuga-city, Fukuoka; Meguru Ohara, Akashi, all of Japan

[73] Assignees: Sanyo Electric Co., Ltd., Osaka; Masahiro Irie, Kasuga; Kobe Natural Products, Kobe, all of Japan

[ * ] Notice: The term of this patent shall not extend beyond the expiration date of Pat. No. 5,443,940.

[21] Appl. No.: 399,971

[22] Filed: Mar. 6, 1995

[30] Foreign Application Priority Data

Mar. 8, 1994 [JP] Japan ..... 6-037308

[51] Int. Cl.[6] ..... G03C 1/73

[52] U.S. Cl. ..... 430/270.15; 430/495.1; 430/962

[58] Field of Search ..... 430/270, 495, 430/962, 270.15, 495.1

[56] References Cited

U.S. PATENT DOCUMENTS

| | | | |
|---|---|---|---|
| 3,715,212 | 2/1973 | Ross | 96/48 |
| 3,918,972 | 11/1975 | Evens et al. | 96/48 |
| 4,780,393 | 10/1988 | Frommeld | 430/292 |
| 4,837,063 | 6/1989 | Irie | 428/64 |
| 4,960,679 | 10/1990 | Nakagiri et al. | 430/335 |
| 5,175,079 | 12/1992 | Van et al. | 430/338 |
| 5,183,726 | 2/1993 | Taniguchi | 430/342 |
| 5,215,868 | 6/1993 | Taniguchi et al. | 430/332 |
| 5,438,561 | 8/1995 | Van et al. | 369/100 |
| 5,443,940 | 8/1995 | Tatezono et al. . | |

FOREIGN PATENT DOCUMENTS

| | | |
|---|---|---|
| 61-215542 | 9/1961 | Japan . |
| 3-261782 | 11/1991 | Japan . |
| 3-261941 | 11/1991 | Japan . |
| 3-261947 | 11/1991 | Japan . |
| 4-282378 | 10/1992 | Japan . |
| 6-167764 | 6/1994 | Japan . |

OTHER PUBLICATIONS

Informal Translation of JP3–261,947, provenance unknown.

*Primary Examiner*—Mark Nagumo

*Attorney, Agent, or Firm*—Armstrong, Westerman, Hattori, McLeland & Naughton

[57] ABSTRACT

An optical material contains a photochromic compound which is expressed in the following general formula (I):

(I)

where A represents an oxygen atom, a nitrogen atom, or a substituted nitrogen atom, B represents a thiophene ring, benzothiophene ring, pyrrole ring or indole ring, $R_1$ represents a methyl group, an alkoxy group or a perfluoroalkyl group, $R_2$ to $R_7$ represent a hydrogen atom, a halogen atom, a hydroxy group, an alkyl group and the like respectively. This photochromic compound may be bonded with a polymer as a side chain in the position of A.

4 Claims, 6 Drawing Sheets

OPTICAL MATERIAL

BACKGROUND OF THE INVENTION

1. Field of the Invention

The present invention relates to an optical material containing a photochromic compound, and more particularly, it relates to a novel optical material having a high reflectance change, which is excellent in durability against repetitive coloring and decoloring.

2. Description of the Background Art

In recent years, study has been widely made on an optical recording medium employing a photochromic compound.

Upon irradiation with light of a prescribed wavelength, such a photochromic compound is changed in molecular structure by photochemical reaction to cause changes in optical properties such as absorbance, optical rotatory power, reflectiveness, a refractive index and the like. When the photochromic compound is irradiated width light of a specific wavelength, the molecular structure as changed returns to the original structure. Therefore, it is possible to record and reproduce information through such differences of the optical properties. Further, it is possible to erase the information by converting the molecular structure to the original structure.

For example, the Japanese journal "Bull. Chem. Soc. Jpn." (1990, Vol. 163, pp. 1311 to 1315) discloses 2,3-bis-(2-methylbenzo[b]thiophene-3-yl) maleic anhydride (which is a diarylethene photochromic compound) as this type of photochromic compound. This photochromic compound enters a photostationary state, i.e., a state containing molecules of both ring-opening and ring-closure states, to be colored red upon irradiation with light of a wavelength near 430 nm, for example, while the same enters a complete ring-opening state upon irradiation with light of a wavelength near 550 nm.

Therefore, it is possible to apply one of such reversibly changed states to a recorded state and the other one to an erased state. Further, it is possible to read information as recorded by irradiating the photochromic material with light of a specific wavelength (550 nm, for example) and detecting differences caused in optical properties such as absorbance between the two states. In general, the difference in absorbance, i.e., the difference in transmittance change or reflectance change between the two states is detected in a general reproducing method, and it is possible to obtain a superior signal as the difference in absorbance is increased. The difference in absorbance can be increased by the following methods:

(1) A method of increasing the concentration of the photochromic material contained in a thin film.

(2) A method of increasing the film thickness.

(3) A method of improving properties, such as a conversion rate and an absorption coefficient, of the photochromic material.

In relation to the aforementioned methods (1) to (3), it is known as to the method (1) that the conversion rate of the conventional diarylethene photochromic material is reduced as its concentration is increased, to have the maximum value in concentration of about 30 to 50 percent by weight with respect to a polymer and that no change in absorbance is improved even if the concentration is increased beyond this value.

As to the method (2), a laser beam which is narrowed through an objective lens is inevitably spread in the direction of depth if the thickness of a recording layer (photochromic material layer) is increased, and hence the recording density is reduced. Therefore, it is necessary to reduce the thickness of the recording layer at least to below 1 μm, and hence the improvement of the absorbance change caused by increasing the film thickness is restricted.

The method (3) is adapted to improve the properties of the photochromic compound itself. The absorption coefficient (liter/mol·cm) means the light absorption ability of the photochromic compound, and the change in absorbance is increased as this value is increased. On the other hand, the conversion rate (%) is a value indicating the rate of molecules which are converted to ring-closure states from ring-opening states upon irradiation with light of a coloring wavelength up to a photostationary state. Thus, the change in absorbance is increased as the value of this conversion rate is increased.

In the conventional diarylethene photochromic compound, however, both of the absorption coefficient and the conversion rate are insufficient, and hence development of a photochromic compound having a large absorption coefficient and a high conversion rate is awaited.

It is also known that such a photochromic compound is deteriorated by a side reaction caused in a photoreaction process upon repetitive coloring and decoloring, and finally enters an unchanged state. The repeatable frequency for such coloring and decoloring corresponds to a reloadable frequency in a case of employing the photochromic compound as the material for an optical recording medium. Therefore, it is possible to improve reliability of the optical recording medium as durability against repetitive coloring and decoloring is improved. Thus, awaited is development of a material having excellent durability against repetitive coloring and decoloring, with improvement in absorption coefficient and conversion rate.

SUMMARY OF THE INVENTION

An object of the present invention is to provide a photochromic compound which can satisfy the aforementioned requirements with a large reflectance change, i.e., a large change in absorbance, and excellent durability against repetitive coloring and decoloring.

The inventive optical material contains a photochromic compound which is expressed in the following general formula (I):

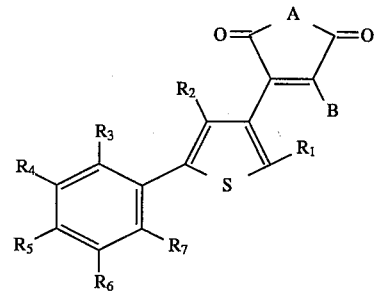

(I)

where A represents an oxygen atom, a nitrogen atom, or a substituted nitrogen atom, B represents a thiophene ring, benzothiophene ring, pyrrole ring or indole ring, $R_1$ represents a methyl group, an alkoxy group or a perfluoroalkyl group, and $R_2$ to $R_7$ represent atoms or groups selected from the group of a hydrogen atom, a halogen atom, a hydroxy group, an alkyl group, an alkoxy group, a cyano group, a nitro group, an alkylcarbonyl group, an alkoxycarbonyl group, a perfluoroalkyl group, an aryl group, an cycloalkyl group, an arylcarbonyl group, an aryloxycarbonyl group, an mono- or dialkylaminocarbonyl group, an alkylcarbonyloxy group, an arylcarbonyloxy group, an aryloxy group, an alkoxycarbonyloxy group and an aryloxycarbonyloxy group respectively. The photochromic compound may be bonded with a polymer as a side chain in the position of A.

According to the present invention, further, the optical material preferably contains a photochromic compound which is expressed in the following general formula (II):

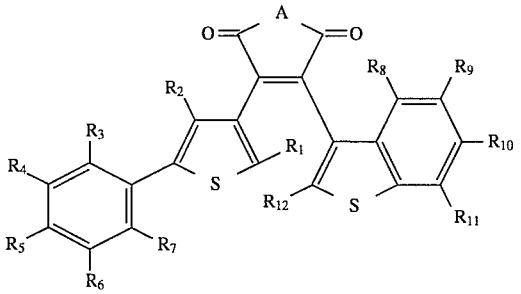

(II)

where A represents an oxygen atom, a nitrogen atom, or a substituted nitrogen atom, $R_1$ and $R_{12}$ represent methyl groups, alkoxy groups or perfluoroalkyl groups, and $R_2$ to $R_{11}$ represent atoms or groups selected from the group of a hydrogen atom, a halogen atom, a hydroxy group, an alkyl group, an alkoxy group, a cyano group, a nitro group, an alkylcarbonyl group, an alkoxycarbonyl group, a perfluoroalkyl group, an aryl group, a cycloalkyl group, an arylcarbonyl group, an aryloxycarbonyl group, a mono- or dialkylaminocarbonyl group, an alkylcarbonyloxy group, an arylcarbonyloxy group, an aryloxy group, an alkoxycarbonyloxy group and an aryloxycarbonyloxy group respectively. The photochromic compound may be boded with a polymer as a side chain in the position of A.

In the above general formula (II), $R_{12}$ preferably represents an alkoxy group. Examples of the alkoxy group are a methoxy group, an ethoxy group and a propoxy group. It is possible to increase the change in absorbance as well as to improve durability against repetitive coloring and decoloring by introducing such an alkoxy group into the position of $R_{12}$.

In the above general formula (II), further, $R_5$ preferably represents an electron donative substituent. It is possible to increase the change in absorbance as well as to improve durability against repetitive coloring and decoloring by introducing such an electron donative substituent into the position of $R_5$. Examples of the electron donative substituent are an alkoxy group, a dimethylamino group and a diethylamino group.

In the photochromic compound which is contained in the inventive optical material, a phenyl group is introduced into the 5-position of the thiophene ring, which is one aryl group of diarylethene, as shown in the above general formula (I). It is conceivable that $\pi$ electron density in the thiophene ring is improved by such introduction of the phenyl group to improve a transition probability with respect to photon absorption, thereby improving the absorption coefficient. It is also conceivable that the change in reflectance etc. is improved due to such improvement of the absorption coefficient when the photochromic compound is applied to an optical material.

According to the present invention, further, durability against repetitive coloring and decoloring is improved. Such improvement in repeating durability can be explained as follows: It is supposed that optical deterioration in coloring and decoloring of diarylethene photochromic compounds mainly results from oxidative deterioration caused by excited oxygen. Particularly in relation to diarylethene photochromic compounds having a thiophene ring, it is supposed that 2-, 4- and 5-position of the thiophene ring are attacked by the excited oxygen to form endoperoxides. In the photochromic compound according to the present invention, a phenyl group is introduced into the 5-position of the thiophene ring. It is presumably possible to suppress the attack of the excited oxygen by the introduction of such a bulky substituent, thereby improving the repeating durability as the result.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Example 1

A compound (A) having the following structural formula was mixed and dissolved in hexane, and thereafter the hexane solution was sealed in an optical cell:

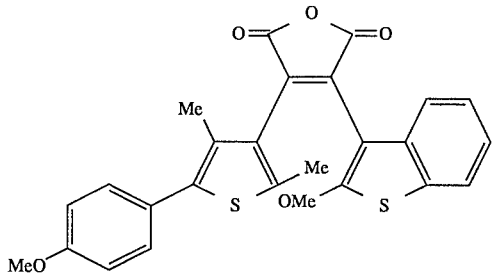

Figure 1:
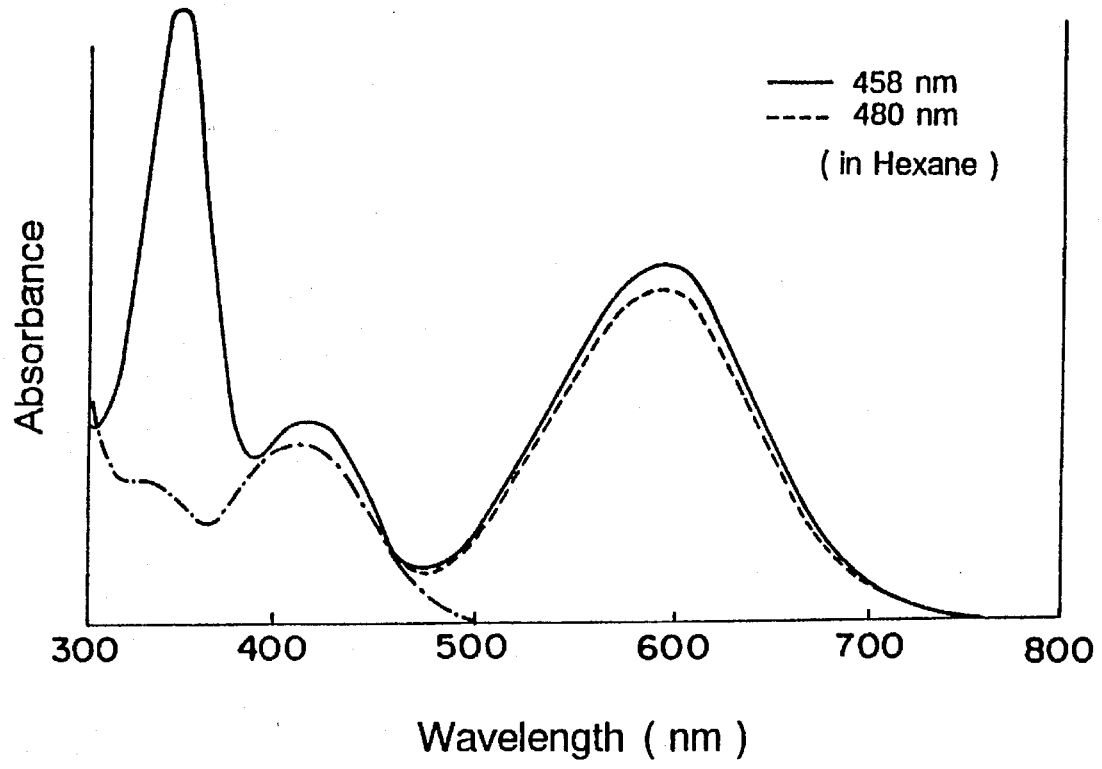
FIG. 1 illustrates absorption spectra of a photochromic compound (A) according to Example of the present invention.

Then, the compound (A) sealed in the optical cell was irradiated with light of 458 nm in wavelength which was emitted from a xenon lamp through an optical filter, to be brought into a photostationary state. The absorption spectrum was measured at this time and thereafter light of 480 nm in wavelength was emitted from a xenon lamp through an optical filter, so that the compound (A) sealed in the optical cell was irradiated with this light to be brought into a photostationary state. The absorption spectrum was measured at this time, and thereafter the compound (A) sealed in the optical cell was further irradiated with light of at least 546 nm in wavelength, so that the absorption spectrum was measured at this time. FIG. 1 illustrates the absorption spectra of the compound (A) obtained in the aforementioned manner. Referring to FIG. 1, solid, dotted and one-dot chain lines show the spectra upon irradiation with the light of 458 nm, the light of 480 nm and the light of 546 nm in wavelength respectively.

Then, absorption coefficients (liter/mol·cm) of the compound (A) were measured in the solution state. The absorption coefficients are obtained by quantifying the amounts of light absorbed by molecules of 1 mole, and large changes are attained as the values thereof are increased. Table 1 shows absorption coefficients of open and closed ring forms of the compound (A) measured in the aforementioned manner.

TABLE 1

| Molecular Absorption Coefficient of Compound (A) (in Hexane) | | | |
|---|---|---|---|
| Open Ring Form (1/mol · cm) | | Closed Ring Form (1/mol · cm) | |
| Absorption Maximum Wavelength | Molecular Absorption coefficient | Absorption Maximum Wavelength | Molecular Absorption coefficient |
| 409 nm | 5500 | 594 nm | 11700 |

Then, conversion rates and transmittance changes were measured in polystyrene thin films containing the compound (A). The polystyrene thin films containing the compound (A) were prepared by dissolving the compound (A) and polystyrene in cyclohexanone and spin-coating the cyclohexanone solutions as obtained on glass substrates. The cyclohexanone solutions were so prepared that concentration values of the photochromic compound (A) were 1, 5, 10, 30 and 50 percent by weight with respect to polymers, for forming the respective thin films. All of the thin films were 2 μm in thickness.

The thin films as obtained were irradiated with light of 458 nm in wavelength to be brought into photostationary states, and subjected to measurement of conversion rates, i.e., conversion yields to closed ring forms, and transmittance changes.

Figure 2:
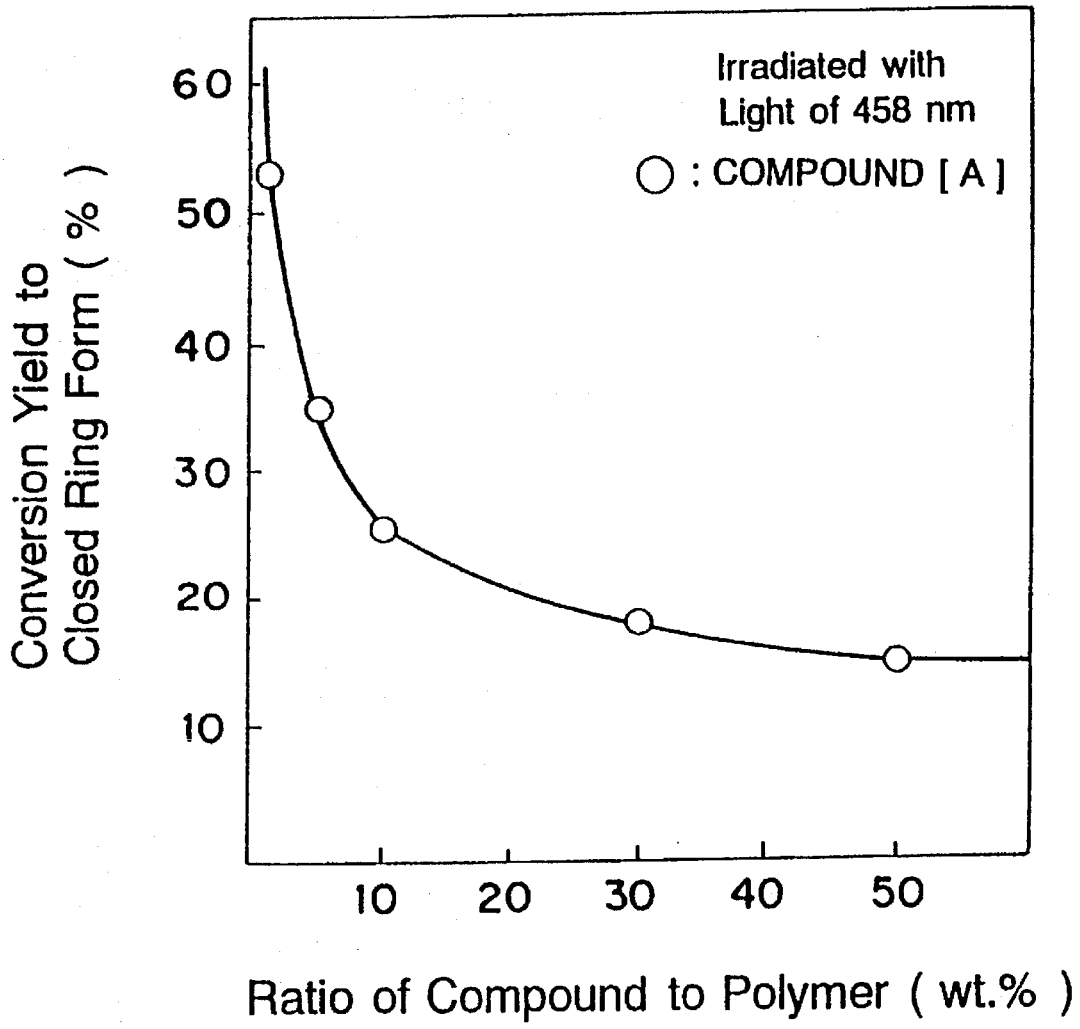
FIG. 2 illustrates conversion yields to closed ring forms in polystyrene thin films containing the compound (A) according to Example of the present invention.

It is understood from FIG. 2 that the conversion yields to closed ring forms were increased as the concentration values of the photochromic compound (A) were reduced in the polystyrene thin films.

Figure 3:
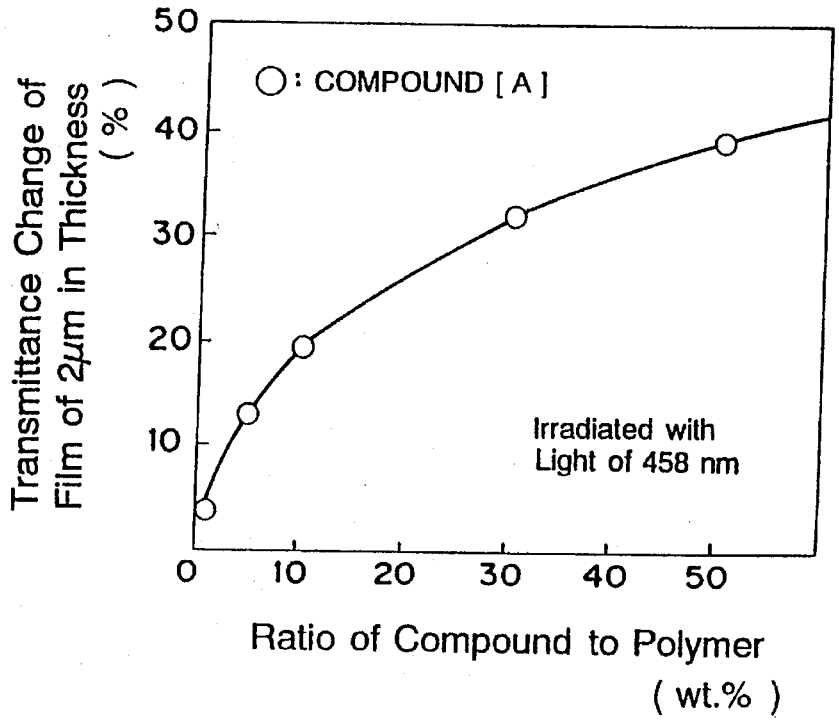
FIG. 3 illustrates changes in transmittance in the polystyrene thin films containing the compound (A) according to Example of the present invention.

Further, it is understood from FIG. 3 that the transmittance changes were improved as the concentration values of the photochromic compound (A) were increased in the polystyrene thin films.

Figure 4:
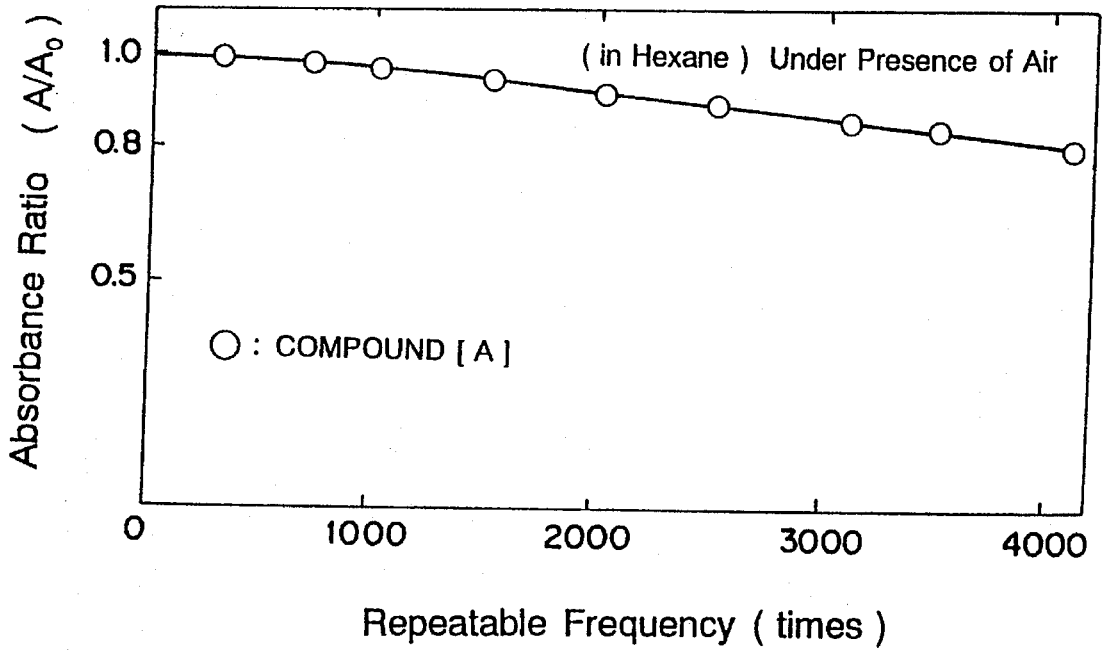
FIG. 4 illustrates repeatable frequencies for coloring and decoloring in the compound (A) according to Example of the present invention.

Optical cells sealing the hexane solutions of the compound (A) were irradiated with coloring light of 436 nm in wavelength to be brought into photostationary states colored by at least 90%, and thereafter irradiated with light of at least 546 nm in wavelength to be brought into 100% ring-opening states, decolored states from the colored states. Such coloring and decoloring were cyclically repeated by a prescribed number of times, and absorbance values (A) at absorption maximum wavelengths in the colored states were measured to obtain ratios ($A/A_0$) to initial absorbance values ($A_0$). FIG. 4 shows the results.

As shown in FIG. 4, the absorbance ratio was reduced to merely about 80% even after repeating coloring and decoloring 4000 times. Thus, it is understood that the photochromic compound according to the present invention is excellent in repeating durability.

Comparative Example 1

Figure 5:
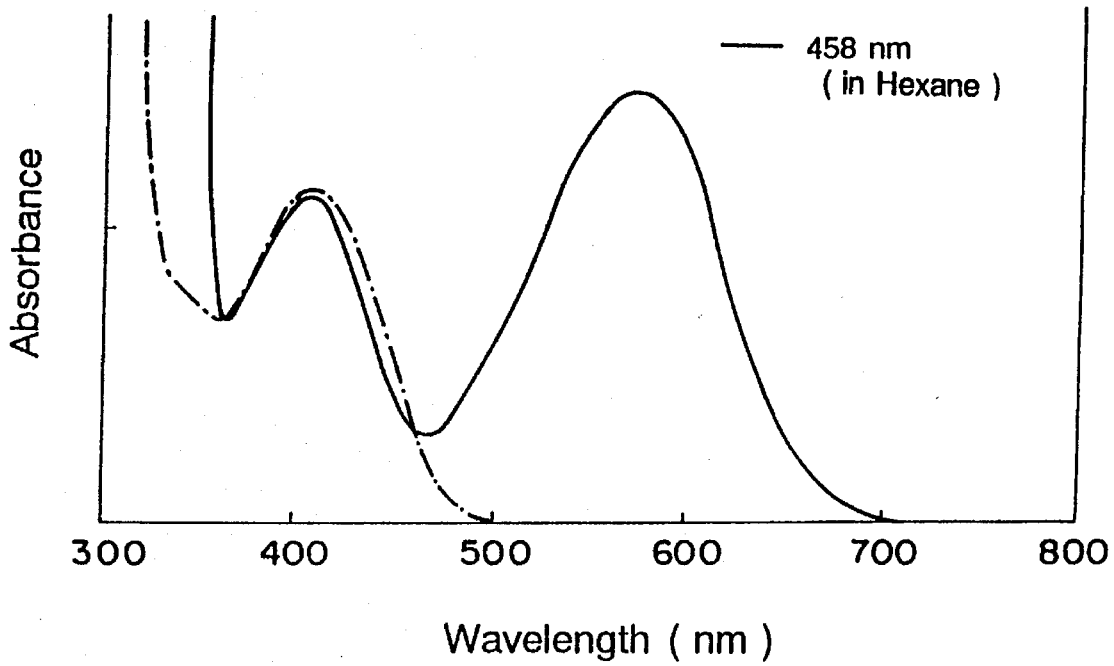
FIG. 5 illustrates absorption spectra of a comparative compound (B)

A comparative compound (B) having the following structural formula was evaluated similarly to Example 1. FIG. 5 illustrates absorption spectra of the compound (B). Referring to FIG. 5, solid and one-dot chain lines show spectra upon irradiation with light of 458 nm and light of 546 nm in wavelength respectively.

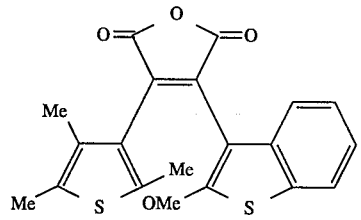

Figure 6:
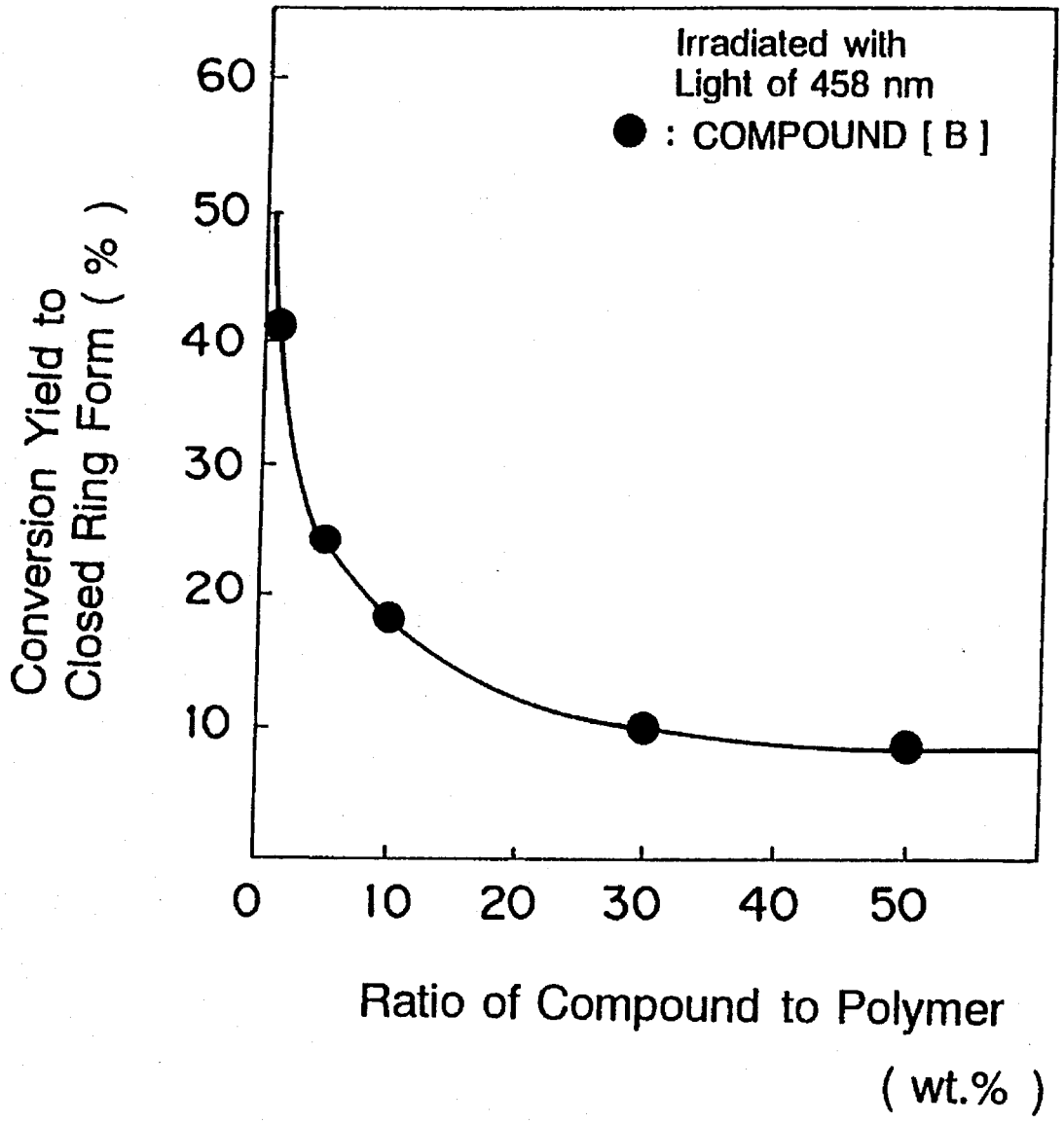
FIG. 6 illustrates conversion yields to closed ring forms in polystyrene thin films containing the comparative compound (B)
Figure 7:
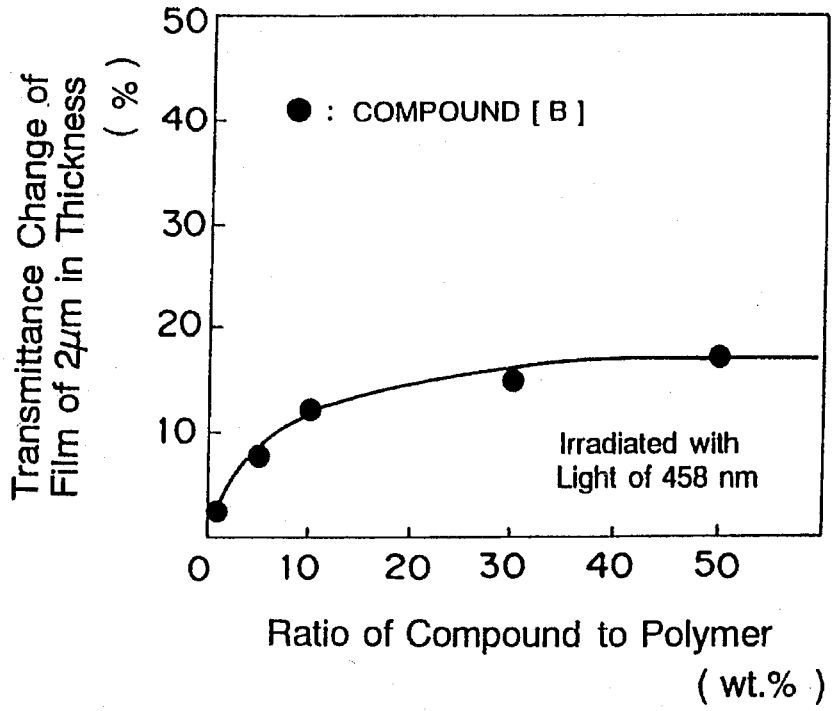
FIG. 7 illustrates changes in transmittance in the polystyrene thin films containing the comparative compound (B)

FIG. 6 shows conversion yields to closed ring forms in polystyrene thin films containing the compound (B), and FIG. 7 shows transmittance changes. It is understood from FIG. 6 that the conversion yields to closed ring forms were lower than those of the inventive compound (A) at the respective concentration levels. Further, it is understood from FIG. 7 that the transmittance changes were also lower as compared with those in the inventive compound (A).

Absorption coefficients in solution states were measured similarly to Example 1. Table 2 shows the absorption coefficients of open and closed ring forms of the compound (B).

TABLE 2

| Molecular Absorption Coefficient of Compound (B) (in Hexane) | | | |
|---|---|---|---|
| Open Ring Form (1/mol · cm) | | Closed Ring Form (1/mol · cm) | |
| Absorption Maximum Wavelength | Molecular Absorption Coefficient | Absorption Maximum Wavelength | Molecular Absorption Coefficient |
| 403 nm | 5800 | 572 nm | 8900 |

Figure 8:
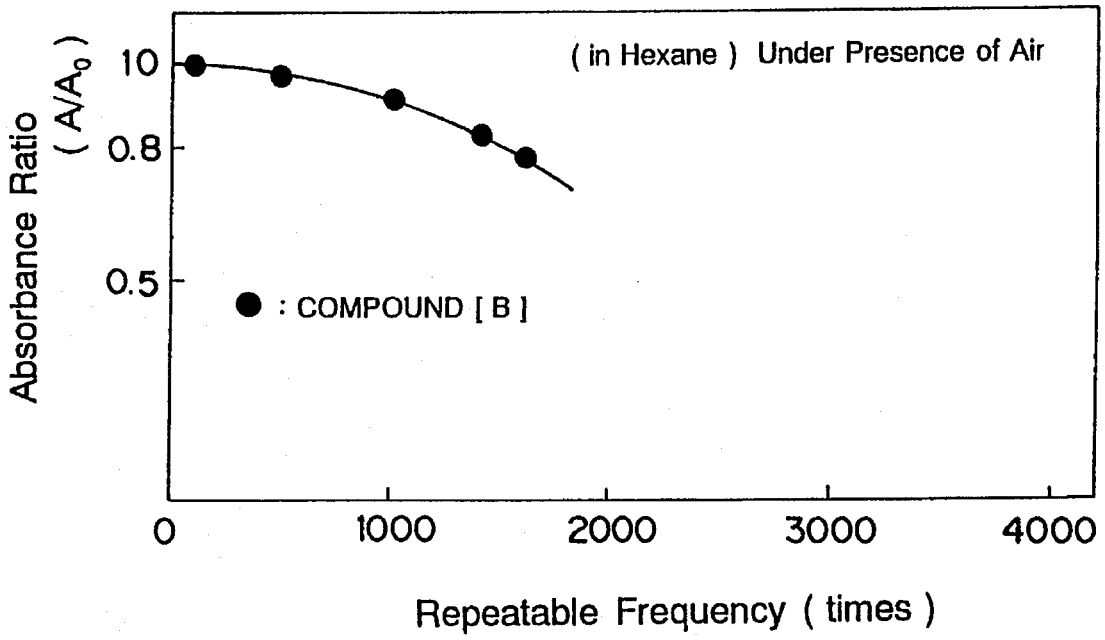
FIG. 8 illustrates repeatable frequencies for coloring and decoloring in the polystyrene thin films containing the comparative compound (B).

FIG. 8 illustrates the results of repeatable frequencies as to the polystyrene films containing the compound (B), which were obtained by repeating coloring and decoloring similarly to Example 1. As shown in FIG. 8, the absorbance of this comparative compound (B) was disadvantageously reduced to 80% after repeating coloring and decoloring about 1500 times.

As clearly understood from the above results, the photochromic compound according to the present invention has a high conversion rate as well as a large transmittance change, and excellent repeating durability with a high repeatable frequency for coloring and decoloring.

In the photochromic compound according to the present invention, a bulky phenyl group is introduced into the 5-position of the thiophene ring, thereby improving the transmittance change while remarkably improving the durability against repetitive coloring and decoloring. Such improvement in transmittance change results from the high absorption coefficient of the inventive photochromic compound and the high conversion rate in a high concentration state.

The optical material according to the present invention is useful not only for optical recording material but also for optical masking material.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An optical material containing a photochromic compound being expressed in the following general formula (II):

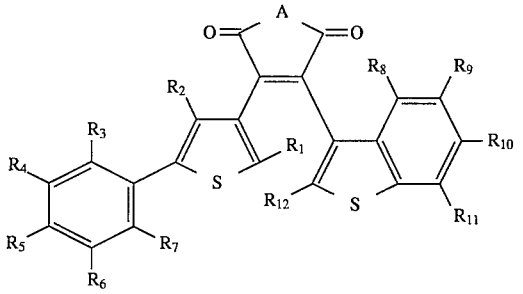

(II)

where A represents an oxygen atom, —NH, or a substituted nitrogen atom, $R_1$ represents a methyl group, an alkoxy group or a perfluoroalkyl group, $R_2$ to $R_4$ and $R_6$ to $R_{11}$ represent atoms or groups selected from the group of a hydrogen atom, a halogen atom, a hydroxy group, an alkyl group, an alkoxy group, a cyano group, a nitro group, an alkylcarbonyl group, an alkoxycarbonyl group, a perfluoroalkyl group, an aryl group, a cycloalkyl group, an arylcarbonyl group, an aryloxycarbonyl group, a monoalkylaminocarbonyl group, a dialkylaminocarbonyl group, an alkylcarbonyloxy group, an arylcarbonyloxy group, an aryloxy group, an alkoxycarbonyloxy group, and an aryloxycarbonyloxy group, said photochromic compound may optionally be bonded to a polymer as a side chain via the position of A, $R_5$ is an alkoxy group, and $R_{12}$ is an alkoxy group or a perfluoroalkyl group.

2. The optical material in accordance with claim 1, wherein $R_{12}$ represents an alkoxy group in said photochromic compound being expressed in said general formula (II).

3. The optical material in accordance with claim 1, wherein $R_{12}$ represents a methoxy group, an ethoxy group or a propoxy group in said photochromic compound being expressed in said general formula (II).

4. The optical material in accordance with claim 1, wherein $R_{12}$ represents a methoxy group in said photochromic compound being expressed in said general formula (II).

* * * * *